United States Patent [19]

Davis

[11] Patent Number: 4,566,602

[45] Date of Patent: Jan. 28, 1986

[54] TAMPER-RESISTANT CLOSURE

[75] Inventor: Eugene E. Davis, Ilford, United Kingdom

[73] Assignee: Johnsen & Jorgensen (Plastics) Limited, London, England

[21] Appl. No.: 686,302

[22] Filed: Dec. 26, 1984

[30] Foreign Application Priority Data

Jan. 3, 1984 [GB] United Kingdom ..... 8400033

[51] Int. Cl.[4] ..... B65D 41/46

[52] U.S. Cl. ..... 215/256; 220/270

[58] Field of Search ..... 215/256, 254; 220/270

[56] References Cited

U.S. PATENT DOCUMENTS

| | | | |
|---|---|---|---|
| 3,300,073 | 1/1967 | Benz | 215/256 X |
| 3,595,420 | 7/1971 | Miskin | 215/256 |
| 3,661,289 | 5/1972 | Segmuller | 215/256 |
| 4,362,253 | 12/1982 | Wortley et al. | 215/256 X |

FOREIGN PATENT DOCUMENTS

| | | | |
|---|---|---|---|
| 1246971 | 9/1971 | United Kingdom | 215/256 |

*Primary Examiner*—Donald F. Norton

*Attorney, Agent, or Firm*—Wood, Dalton, Phillips, Mason & Rowe

[57] ABSTRACT

The invention provides a container closure with a top, a skirt depending from the top, a tear-away tamper resistant band connected to the skirt by frangible means and a tear tab on the band arranged so that it is inclined upwardly and outwardly in order to ensure that when a container with a closure in position is being packed into a carbon bottom end first the tear tab on the closures does not catch on the rim of the carton. Preferably the tear tab is connected by a frangible tongue to a thumb push on the skirt and disposed immediately above the tear tab.

9 Claims, 5 Drawing Figures

TAMPER-RESISTANT CLOSURE

BACKGROUND ART

This invention relates to tamper-resistant closures for containers and to tamper-resistant container assemblies. For quite a number of years we have been making and selling containers, under our Registered Trade Mark SECURITAINER, covered by our British Pat. No. 1246971. Our SECURITAINER containers (hereinafter called packs) have proved to be very effective and have had a considerable commercial success and we believe the SECURITAINER pack to be the best pack of its kind on the market. On the other hand the very success of the SECURITAINER pack has meant that the pack has been used in many different industries for packing a wide variety of products and this has led to the identification of one or two problems which in turn has led us to carry out a series of investigative experiments and long-term development to see whether we could find solutions.

The problems that customers have referred to us may be summarized as follows:

1. Some customers have had difficulty when automatically packing or stacking existing SECURITAINER packs into cartons for transport and/or storage. This difficulty is due to the fact that each pack has a protruding thumb tab and tear tab on the closure. If a filled and sealed SECURITAINER pack be pushed "head first" into an outer carton then the ramp above the thumb tab in the current design generally guides the thumb tab—with the tear tab partially shielded below it—into the carton, so that the pack does not "catch" on the edge of the carton. Even if the two tabs be dead in line with the centre line of the carton wall the web and thumb tab will usually push the carton into a bowed shape so that the entire pack will be pushed in—albeit distorting the carton somewhat in the process. The problem comes when the packs are fed bottom or "feet first" into the carton, which is really the normal way of feeding in the packs. When this method of feeding in is adopted the tear tab and the thumb tab above it present a hooked surface to the carton and a pack may "catch" or snag on the edge of the carton in such a way that continued pushing will or may damage the carton or even the pack. In other words in the existing design of SECURITAINER packs the tear tab not only projects sideways so as to be easily gripped by the user but it also projects donwardly and thus presents, what we have referred to above as a hooked surface, to the carton.
2. Some customers, whose products need special protection against moisture, are finding that the existing design of SECURITAINER pack does not achieve a sufficiently consistent Moisture Vapour Transmission (MVT) performance. This can sometimes be a critical factor especially with medical products and essentially this is a sealing problem.
3. In the world that is becoming ever more conscious of the need for effective tamper-resistance there has been some criticism of the tamper-resistant qualities of the existing SECURITAINER pack especially the larger sizes. Due to problems of scale it has proved feasible for dexterous people to remove or persuade the entire cap off an existing large size SECURITAINER body and to replace the cap without leaving evidence of removal. This can be only partially, though not completely, overcome by changing the material formulation to give a stiffer grade and so a stiffer product.
4. For similar reasons of scale, it can sometimes be difficult and indeed painful to remove the cap from a small size of SECURITAINER pack. One only has to imagine the problems and discomfort of a Nurse doing her ward round and having to remove a dozen or so of these caps in a half hour or so period of dispensing tablets to patients.
5. Some customers have noted that with the existing design of SECURITAINER pack there is an inconsistent reclosure performance in the sense that some caps are almost too easy to put back on, others are reluctant to clip on properly and yet others are too difficult to put back on. This difficulty is again associated with problems of size and scale.
6. The reclosure problem and a problem of cap retention is connected to some extent with a manufacturing difficulty with the existing design of cap in which the precise position of the upper membrane or weakened line is somewhat critical. We have found that it is difficult to maintain the desired degree of accuracy in the position of the upper membrane so that if the resultant "clip over" is too thin then cap retention is tenuous and if the "clip over" be too thick then cap retention is too strong. By "clip over" we mean the engagement of the cap with the annular retention bead on the body. For correct reclosure the positon of the upper membrane on the cap relative to the annular bead on the body is critical and it is difficult to allow sufficient manufacturing tolerance.

We repeat that the existing form of SECURITAINER pack is extremely successful and the problems which we have highlighted above are relatively minor compared with the undoubted advantages of the SECURITAINER pack as compared with other packs now available. Nevertheless it would be advantageous to improve our SECURITAINER packs and it is the object of this invention to do just that,

SUMMARY OF THE INVENTION

According to a feature of the present invention we provide a closure for a container wherein the closure has a top, a skirt depending from the top, a tear away tamper-resistant band connected by frangible means to the skirt and a tear tab on the band characterised in that the tear tab is arranged so that it is inclined outwardly and upwardly so that if the tear tab contacts the rim of a carton when a container, including the closure in position thereon, is being packed into a carton bottom end first the tear tab slides over the rim and does not catch or become hooked on the rim. Preferably a thumb tab or thumb push is provided on the skirt of the closure and is positioned directly above the tear tab. The thumb tab or thumb push may be in the form of a guard member projecting outwardly from the skirt of the closure so that the tear tab may be connectd by frangible means to the guard. By this construction the frangible connecting means not only holds the tear tab in an upwardly inclined position but also provides an extra tamper evident feature. Further we prefer to make the guard project outwardly and downwardly so that the tear tab and the thumb tab or push in reality come substantially to a point at their outer extremity and an inclined ramp is provided to guide the pack into a carton which ever way up the pack is fed into the carton i.e. bottom first or top first.

BRIEF DESCRIPTION OF THE DRAWINGS

In order that the invention may be more clearly understood reference is now directed to the accompanying drawings, given by way of example in which.

DETAILED DESCRIPTION OF THE DRAWINGS

Figure 1:
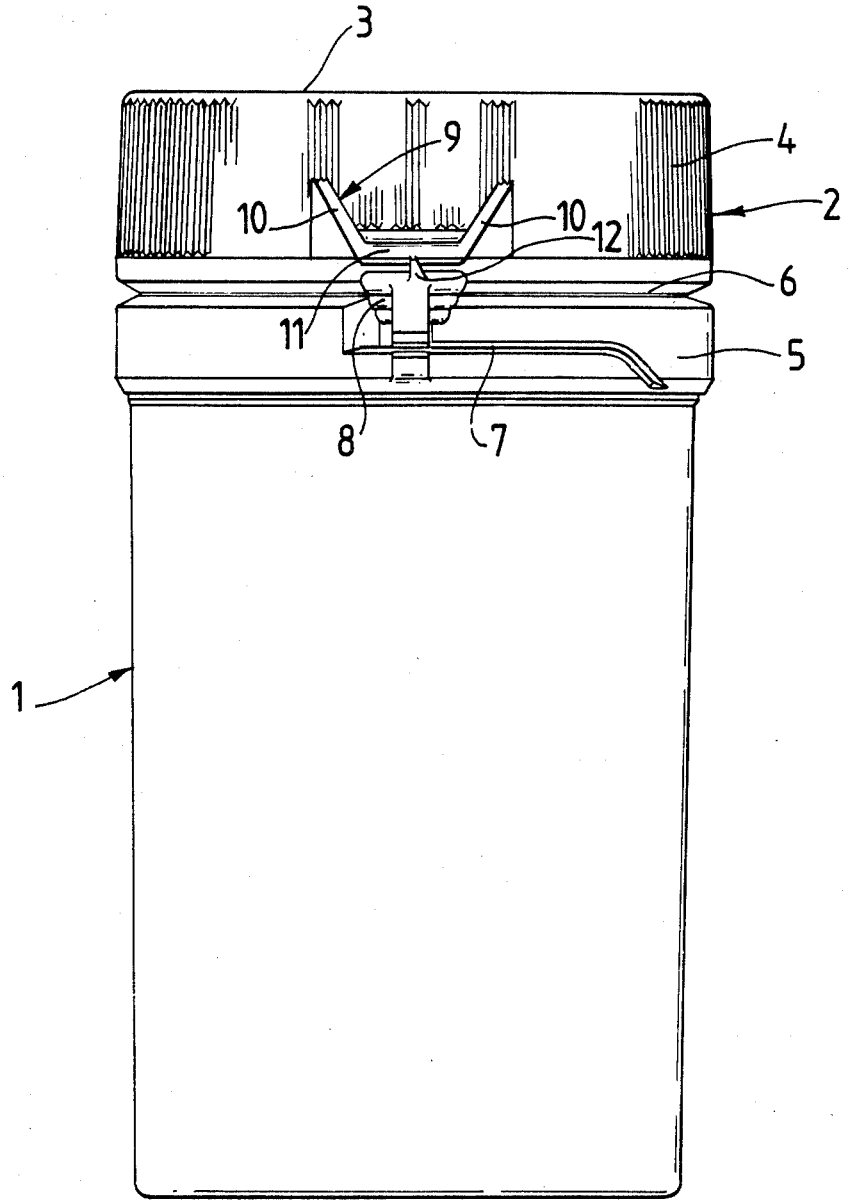
FIG. 1 is a first side elevation of a closure and container assembly according to the invention.
Figure 2:
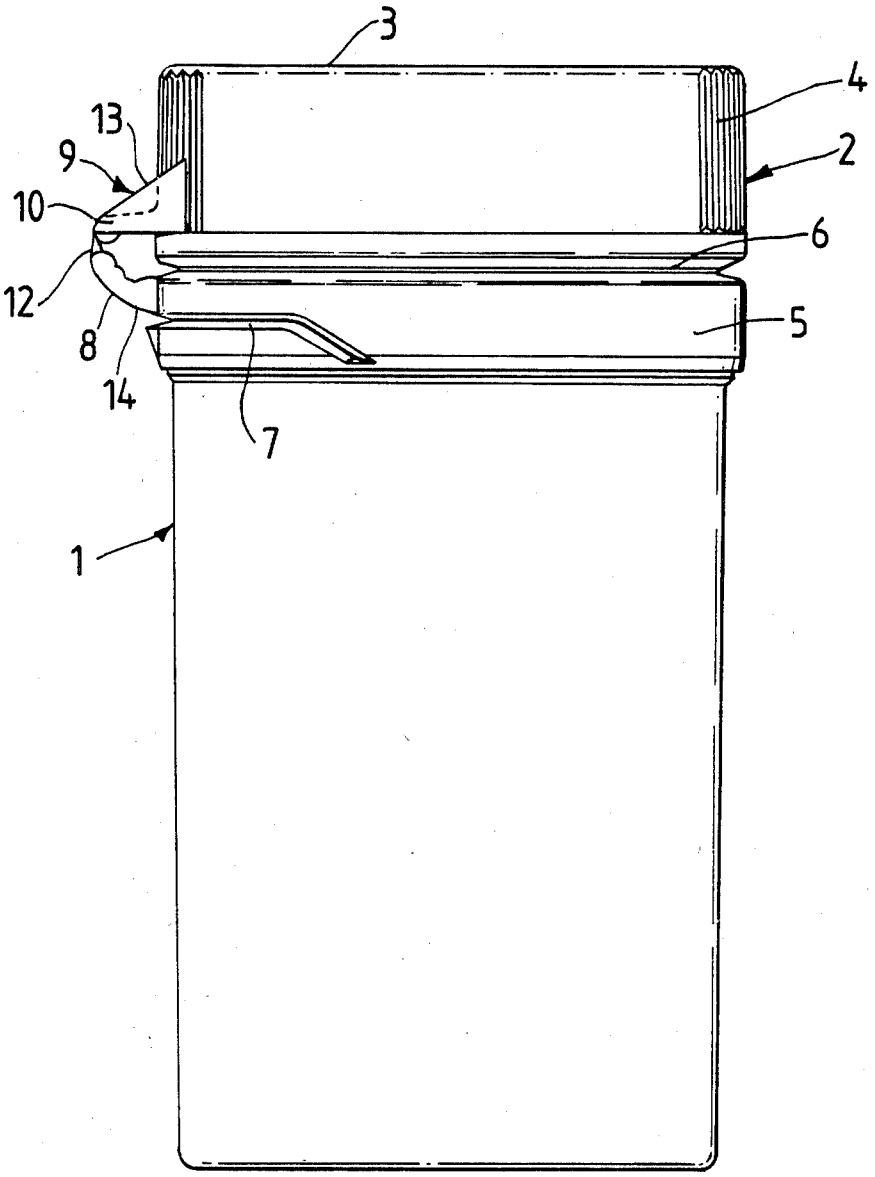
FIG. 2 is a second side elevation of the closure and container assembly shown in FIG. 1 with the assembly turned through 90° as compared with FIG. 1.

Referring first to FIGS. 1 and 2 which show a container and closure assembly designed particularly to overcome the first difficulty or problem referred to above a container 1 has a closure 2 comprising a top 3, a depending skirt 4, a tear band 5 frangible membranes or lines 6 and 7 of weakness and a tear tab 8. A thumb tab or thumb push 9 is also provided and comprises a guard with downwardly inclined side walls 10 at each side and a substantially horizontal cross-member 11 connecting the side walls 10 to each other, the cross-member 11 being disposed immediately above the tear tab 8. Frangible means 12, in the form of a tongue, is provided to connect the cross-member 11 to the end of the tear tab 8 so that the tear tab 8 is retained in its upwardly and outwardly inclined position as shown in FIG. 2. The guard therefore functions not only as thumb tab or push to assist in removing the closure 2 from the container 1 when the tear band 5 has been torn away but also as an anchor for the tear tab 8 when the band 5 is in position.

Inspection of FIG. 2 will show that the combination of the tear tab 8, the frangible connector 12 and the thumb tab or push 9 formed by the guard sidewall 10 or horizontal cross-member 11 provide a functional projecting assembly of substantially the shape of a letter V lying on its side in the sense that the side walls 10 of the guard are inclined downwardly and outwardly away from the top 3 of the closure 2 at an angle along the line 13 and the tear tab is inclined upwardly and outwardly toward the top 3 of the closure at an angle along the line 14 so that the lines 13 and 14 meet at an apex at the frangible connector 12. This arrangement means that there is always an inclined ramp to slide on the edge of a carton whichever way up the containers are being packed into a carton.

Figure 3:
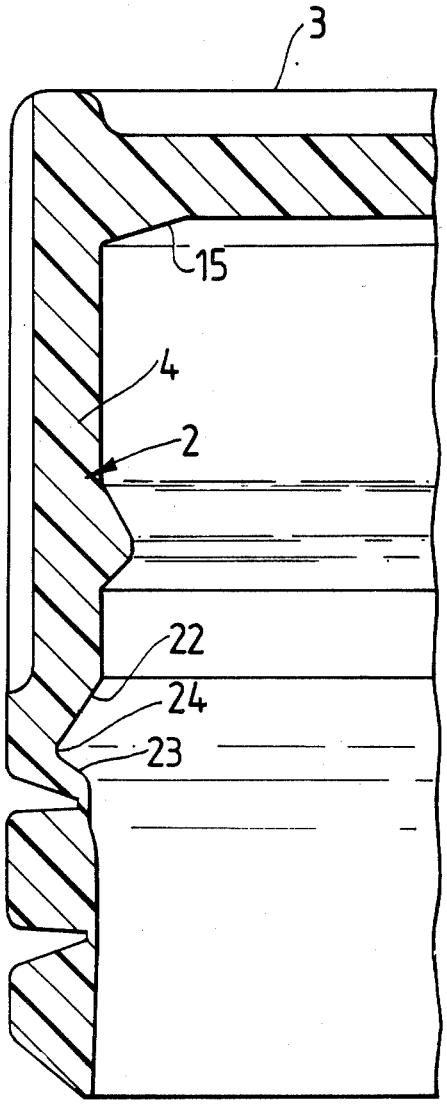
FIG. 3 is a longitudinal sectional view of a closure to the present design and not embodying a feature of the invention.

To overcome the second problem mentioned above we may provide an extra sealing feature by arranging that a bead 19 on the closure engages with a special bead 20 on the container body. This provides a secondary sealing system described in more detail in relation to FIG. 5 to give a more consistent MVT performance. Our usual tapered seal is shown at 15 in FIG. 3 and when the closure 2 is on the container body 1 the seal 15 presses on the rim around the mouth of the container body 1.

Figure 4:
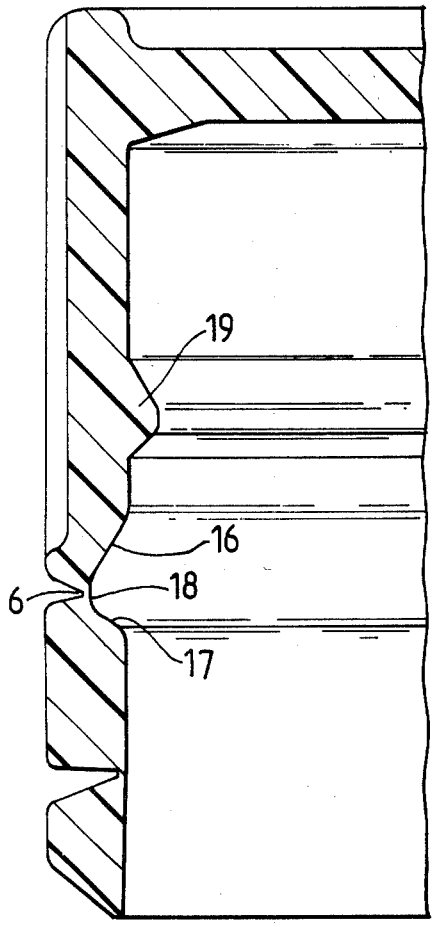
FIG. 4 is a longitudinal sectional view of a closure embodying anothr feature of the invention.

To overcome the third problem mentioned above we may provide a closure 2 in which the position of the upper membrane 6 is not as critical as in the present cap. At present we provide a closure shaped as in FIG. 3 so that the inner profile of the lower part of the skirt is inclined outwardly at 22 and then inwardly at 23, the two inclined profiles meeting at an intersection point at 24 above the upper membrane. According to a feature of this invention we may extend the intersection point to an intersection area by the provision of a substantially vertical land between the two inclined profiles. This aspect of the present invention is illustrated in FIG. 4 in which the outwardly inclined profile of the skirt is indicated at 16 and the inwardly inclined profile at 17, the substantially vertical land being shown at 18. The upper or main membrane 6 can now be disposed more or less in the middle of the vertical land 18 and with this arrangement the membrane 6 does not require tight tolerancing. In addition the membrane 6 may be thickened as compared with the present design due to the fact that the precise position of the membrane is no longer a critical factor and this thickening of the membrane 6 enhances material flow into the tear band 5 of the closure 2 during the moulding operation. In addition, this new arrangement enables us to increase the step inside the tear band 5 which is provided by the profile 17 because we are no longer trying to register the membrane 6 with that part of the tear band 5. In this way we find that the tear band 5 locks under its retaining bead on the container body 1 much more firmly than in the present assembly. This arrangement really solves problems 3, 4, 5 and 6 which are all inter-related.

In addition the new design enables us to use bead 19 intermediate the internal length of the skirt of the closure as a clipover bead as well as the primary sealing bead function. This bead 19 on the inside of the closure is arranged, in operation, to pass below a shallow bead which we are now able to form on the outside of the container body. This shallow bead is indicated at 20 in the diagrammatic view FIG. 5 and the co-operation of annular beads 19 and 20 provides a clip-on feature and (for the first time) the clip-on reclosure function can be treated as a separate entity from the initial tamper resistant one working in isolation to each other to help to solve problems 4 and 5. As a result of all this we are now able to increase the tamper resistance of what we now call our Mk IV SECURITAINER packs by making the "nose" or annular bead on the container protrude further than before. This annular "big nose" is indicated at 21 in FIG. 5, and this also helps to solve problem 3.

Figure 5:
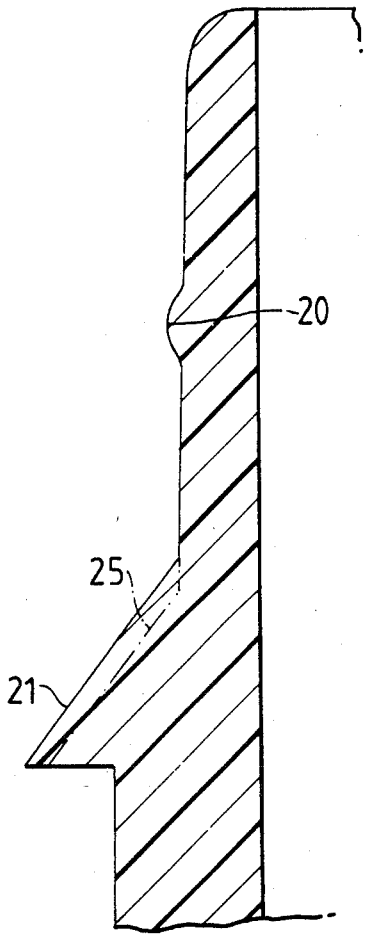
FIG. 5 is a diagrammatic view of a container body.

Finally we may enlarge the thumb tab to reduce the effort required to remove the tighter closures. However this may in fact be unnecessary and we may well be able to revert to the earlier design or thumb when the other modifications are incorporated because cap removal should be eased to a significant extent and the original size of thumb tab may suffice and it may even be possible to remove the thumb tab altogether and simply attach the tear tab direct to the skirt by frangible means. The dot/dash line 25 in FIG. 5 shows the previous outline of the bead 21, to indicate that in the new design the diameter of the annular bead 21 is substantially increased.

I claim:

1. A closure for a container wherein the closure has a top, a skirt depending from the top, a tear-away tamper-resistant band connected by frangible means to the skirt and a tear tab on the band characterised in that the tear tab is arranged so that it is inclined outwardly and upwardly so that if the tear tab contacts the rim of a carton when a container, including the closure in position thereon, is being packed into a carton bottom end first the tear tab slides over the rim and does not catch or become hooked on the rim.

2. A closure according to claim 1 characterised in that a thumb push is provided on the skirt of the closure and is positioned directly above the tear tab, the thumb push being in the form of a guard member projecting outwardly from the skirt of the closure and connected to the tear tab by frangible means.

3. A closure according to claim 2 characterised in that the guard member projects outwardly and downwardly so that the tear tab and the thumb tab come substantially to a point at their outer extremity and an inclined ramp is provided to guide the container into a carton.

4. A closure according to claim 2 or 3 characterised in that the thumb push has a downwardly inclined side wall at each side and a substantially horizontal cross-member connecting the side walls to each other, the cross-member being immediately above the tear tab and frangible means being provided to connect the cross-member to the end of the tear tab so that the tear tab is retained in its upwardly and outwardly inclined position.

5. A closure according to claim 1 characterised in that to improve the sealing of the closure when in operative position the closure is provided with an annular internal bead for co-operation with a bead provided on the external surface of the associated container body.

6. A closure according to claim 5 characterized in that the inner profile of the lower part of the skirt is inclined outwardly and then inwardly with a substantially flat and vertical intersection area or land between the outwardly and inwardly inclined parts of the inner profile.

7. A closure according to claim 6 characterised in that the annular bead is operative not only as a sealing feature but also has a clip-over function for co-operation with a shallow bead on the outside of the container body.

8. A closure according to claim 1 characterized in that the inner profile of the lower part of the skirt is inclined outwardly and then inwardly with a substantially flat and vertical intersection area or land between the outwardly and inwardly inclined parts of the inner profile.

9. A closure and container body assembly wherein the closure has a top, a skirt depending from the top, a tear away tamper resistant band connected by a frangible membrane to the bottom of the skirt and a tear tab on the band and wherein the container body has a bottom, a side wall, an open mouth at the top and an external bead adjacent to the mouth characterised in that the tear tab is inclined outwardly and upwardly and is connected at its outer end by a frangible tongue to a thumb push provided on the skirt and disposed in the manner of a guard immediately above the tear tab on the band and further characterised in that the inner profile of the lower part of the skirt is inclined outwardly and then inwardly with a substantially flat and vertical annular intersection land between the two inclined parts of the inner profile, the arrangement being such that the frangible membrane on the closure connecting the skirt to the band is disposed adjacent to the middle of the vertical land.

* * * * *